US008412560B1

(12) United States Patent
Masud et al.

(10) Patent No.: US 8,412,560 B1
(45) Date of Patent: Apr. 2, 2013

(54) PRICE OPTIMIZATION USING CURRENT OFFERS

(75) Inventors: Faisal Masud, Issaquah, WA (US); Stacy Saal, Bellevue, WA (US); Paul D. Ohlhaut, Seattle, WA (US); Josiah P. Olivieri, Bellevue, WA (US); Umair Bashir, Issaquah, WA (US); Xiao Yu, Waterloo (CA); Tao Hu, Renton, WA (US)

(73) Assignee: Amazon Technologies, Inc., Reno, NV (US)

( * ) Notice: Subject to any disclaimer, the term of this patent is extended or adjusted under 35 U.S.C. 154(b) by 369 days.

(21) Appl. No.: 12/718,032

(22) Filed: Mar. 5, 2010

(51) Int. Cl.
*G06Q 30/00* (2012.01)

(52) U.S. Cl. ..... 705/7.35

(58) Field of Classification Search ..... 705/7.35
See application file for complete search history.

(56) References Cited

U.S. PATENT DOCUMENTS 6,038,554 A * 3/2000 Vig ..... 705/400
2002/0072958 A1* 6/2002 Yuyama et al. ..... 705/10
2005/0038717 A1* 2/2005 McQueen et al. ..... 705/27
2005/0044050 A1* 2/2005 Hendrickson et al. ..... 705/400
2006/0265259 A1* 11/2006 Diana et al. ..... 705/7
2007/0130090 A1* 6/2007 Staib et al. ..... 705/400
2007/0214066 A1* 9/2007 Harding et al. ..... 705/28
2007/0250403 A1* 10/2007 Altschuler ..... 705/26
2007/0294123 A1* 12/2007 Keser et al. ..... 705/10
2008/0004981 A1* 1/2008 Gopalpur et al. ..... 705/26
2008/0015964 A1* 1/2008 Shuster ..... 705/36 R

OTHER PUBLICATIONS

DiRusso, David John, An Examination of Price Dispersion in an Online Retail Marketplace, Temple University, Jan. 2010.*

* cited by examiner

*Primary Examiner* — Nathan Erb
(74) *Attorney, Agent, or Firm* — Thomas | Horstemeyer, LLP

(57) ABSTRACT

Disclosed are various embodiments for optimizing prices of items using current offers. Numerous current offers to sell an item are determined from a subset of sellers in an electronic marketplace. Each one of the subset of sellers is associated with a respective reputational score that meets a minimum threshold. A competitive price is generated for the item based at least in part on an average marketplace price determined from the current offers.

26 Claims, 4 Drawing Sheets

PRICE OPTIMIZATION USING CURRENT OFFERS

BACKGROUND

It can be very difficult to determine the fair market value of a product that a company or person wishes to sell. This is because there can be many different factors that bear on the fair market value of a product that can make it difficult to pinpoint the exact value of a product at any given time. For example, if a product has been rendered obsolete by the introduction of a newer version of the same product by a given manufacturer, then the fair market value may drop. Also, unanticipated market forces such as changes in consumer demand in light of popular culture can influence the fair market value at any given time. Because of the difficulty in determining the fair market value of a product at any given time, it is possible for a product to be sold at a price that is too high or too low. When a price is too high, inventory builds up and, correspondingly, the cost of storing inventory increases. When a price is too low, inventory may be depleted and profit is reduced.

BRIEF DESCRIPTION OF THE DRAWINGS

Many aspects of the present disclosure can be better understood with reference to the following drawings. The components in the drawings are not necessarily to scale, emphasis instead being placed upon clearly illustrating the principles of the disclosure. Moreover, in the drawings, like reference numerals designate corresponding parts throughout the several views.

DETAILED DESCRIPTION

The present disclosure is directed at optimizing prices of items using current offers and other pricing data. As used herein, the term "item" refers to any product, service, digital download, and/or any other type of item that may be purchased at a price. Many factors may be used in assessing the fair market value of an item and generating a competitive price. In one embodiment, when too few current offers that are credible are available, a competitive price for an item may be determined from past sales of the item. In another embodiment, a competitive price for an item may be determined using a blend of past sales of an item with current offers for the item. To provide a comprehensive pricing solution, an item may be priced using, for example, a list price of the item or a percentage relative to a list price of an item when sufficient data regarding past sale prices or current offer prices are not available. In the following discussion, a general description of the system and its components is provided, followed by a discussion of the operation of the same.

Figure 1:
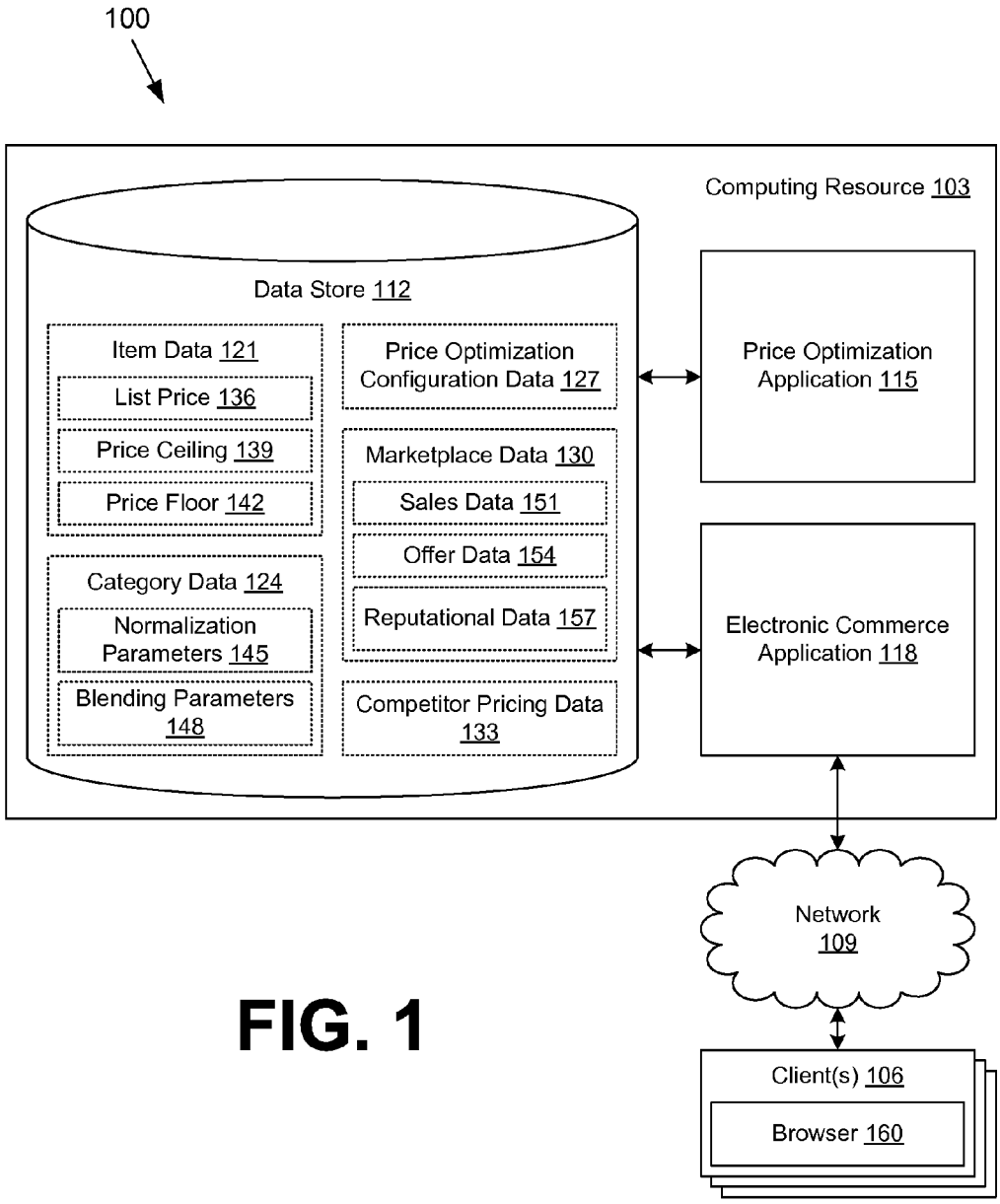
FIG. 1 is a drawing of a networked environment according to various embodiments of the present disclosure.

With reference to FIG. 1, shown is a networked environment 100 according to various embodiments. The networked environment 100 includes a computing resource 103 in data communication with one or more clients 106 by way of a network 109. The network 109 includes, for example, the Internet, intranets, extranets, wide area networks (WANs), local area networks (LANs), wired networks, wireless networks, or other suitable networks, etc., or any combination of two or more such networks.

The computing resource 103 may comprise, for example, a server computer or any other computing device or system providing computing capability. The computing resource 103 may represent multiple computer systems arranged, for example, in one or more server banks or other arrangements. To this end, the computing resource 103 may comprise, for example, a cloud computing resource, a grid computing resource, and/or any other distributed computing arrangement. Such computer systems may be located in a single installation or may be dispersed among many different geographical locations. In one embodiment, the computing resource 103 represents a virtualized computer system executing on one or more physical computing systems. For purposes of convenience, the computing resource 103 is referred to herein in the singular. However, in one embodiment, the computing resource 103 represents a plurality of computer systems arranged as described above.

Various applications and/or other functionality may be executed in the computing resource 103 according to various embodiments. Also, various data is stored in a data store 112 that is accessible to the computing resource 103. The data store 112 may be representative of a plurality of data stores as can be appreciated. The data stored in the data store 112, for example, is associated with the operation of the various applications and/or functional entities described below.

The components executed on the computing resource 103, for example, include a price optimization application 115, an electronic commerce application 118, and other applications, services, processes, systems, engines, or functionality not discussed in detail herein. The price optimization application 115 is executed to analyze pricing data from the data store 112 to generate competitive prices for items in a stated item condition or classification.

The electronic commerce application 118 is executed to facilitate the online purchase of items over various networks such as, for example, the Internet or other network as can be appreciated. The electronic commerce application 118 also performs various backend functions associated with the online presence of a merchant and/or an electronic marketplace in order to facilitate the online purchase of items. For example, the electronic commerce application 118 may generate network pages, such as web pages or other types of network content, that are provided to the client 106. In one embodiment, the electronic commerce application 118 facilitates order origination for each seller in an electronic marketplace.

The data stored in the data store 112 includes, for example, item data 121, category data 124, price optimization configuration data 127, marketplace data 130, competitor pricing data 133, and potentially other data. The item data 121 includes various information about items offered for sale through network sites served up through the electronic commerce application 118. The item data 121 may include, for example, a list price 136, a price ceiling 139, a price floor 142, and potentially other data.

The list price 136 may be, for example, a manufacturer's suggested retail price or some other price which may be established as a reference price for a respective item. The price ceiling 139 may be a maximum price at which the merchant is willing to sell the item. Such a price ceiling 139 may be defined, for example, relative to the list price 136 or some other price of the item available to the computing resource 103. The price floor 142 may be the minimum price at which a seller is willing to sell the item. Such a price floor 142 may be, in some embodiments, a liquidation value for the item, or the price that a liquidator is willing to pay the seller for the item.

The category data 124 may contain data related to categories of items. A category may comprise a division of items such as, for example, "books," "electronics," "lawn and garden," "apparel," "music," and so on. The category data 124 may include, for example, normalization parameters 145, blending parameters 148, and potentially other data. Although the price ceiling 139 and the price floor 142 are depicted as within the item data 121, the price ceiling 139 and the price floor 142 may be configured on a per-category basis based at least in part on the category of an item as desired.

The normalization parameters 145 may be used to normalize a condition of an item. In one embodiment, item conditions may include "new," "like new," "very good," "good," "acceptable," and/or other classifications. The normalization parameters 145 include pricing factors in order to transform a price for an item at one of the item conditions to a common condition or classification (i.e., a normalized condition). In one embodiment, item conditions are normalized to the "new" condition. Such normalization parameters 145 may depend on the specific category.

The blending parameters 148 may describe a blending strategy for pricing a particular category. To this end, the blending parameters 148 may weigh, for example, data from past sales versus data from current offers. In various embodiments, the blending parameters 148 may specify blending of various other data in order to arrive at an optimized price for items within the specific category.

The price optimization configuration data 127 may include parameters used in selecting options for optimizing prices. For example, price optimization configuration data 127 may describe post-processing of prices, catalog-wide blending parameters 148, etc.

The marketplace data 130 includes data that describes an electronic marketplace. The electronic marketplace may comprise one or more network sites wherein multiple sellers offer items for sale. In various embodiments, an electronic marketplace provides a unified interface through which to order items. In one embodiment, the proprietor of the electronic marketplace is the operator of the price optimization application 115.

The marketplace data 130 may comprise, for example, sales data 151, offer data 154, reputational data 157, and potentially other data. The sales data 151 describes a plurality of past sales for items within the electronic marketplace. The sales data 151 may describe item conditions along with sale prices for each sale. The offer data 154 describes a plurality of current offers to sell items through the electronic marketplace. The offer data 154 may also describe item conditions associated with the offers. The reputational data 157 includes data related to the reputation of a seller in the marketplace. Reputational data 157 may include, for example, customer feedback ratings and/or other reputational data 157.

The competitor pricing data 133 may include data related to pricing of items by competitors. Such competitors are sellers that are not included within the electronic marketplace. In various embodiments, the competitor pricing data 133 may be more limited than data available within the marketplace data 130.

The client 106 is representative of a plurality of client devices that may be coupled to the network 109. The client 106 may comprise, for example, a processor-based system such as a computer system. Such a computer system may be embodied in the form of a desktop computer, a laptop computer, a personal digital assistant, a cellular telephone, set-top box, music players, web pads, tablet computer systems, or other devices with like capability.

The client 106 may be configured to execute various applications such as a browser 160 and/or other applications. The browser 160 may be executed in a client 106, for example, to access and render network pages, such as web pages, or other network content served up by the computing resource 103 and/or other servers. The client 106 may be configured to execute applications beyond browser 160 such as, for example, email applications, instant message applications, and/or other applications.

Next, a general description of the operation of the various components of the networked environment 100 is provided. To begin, a user at a client 106 accesses a network site served up by the electronic commerce application 118 and orders an item. Such an item may have an item condition classification such as "new," "like new," "very good," "good," "acceptable," and/or other item condition. After the sale is completed, the electronic commerce application 118 records the associated data within the data store 112, and the sales data 151 is ultimately updated. In this way, the sales data 151 records a plurality of past sale prices for the items.

Additionally, another user at a client 106 may access the electronic commerce application 118 over the network 109 to configure a seller account on the electronic marketplace. Accordingly, offers by this seller on the electronic marketplace may be added, updated, deleted, and/or subject to some other action. Consequently, the offer data 154 may be updated to include the latest current offers for items. Again, each item offered for sale by a seller in the electronic marketplace may be associated with an item condition classification.

The price optimization application 115 may be executed according to a predefined time interval, a command sent by a user over the network 109 from the client 106, a change in data stored within the data store 112, and/or in response to some other condition. The price optimization application 115 may optimize the price of one item or any number of items, such as a catalog of items offered by a seller or a proprietor of an electronic marketplace. Although the price optimization application 115 may be executed to determine prices for multiple items and for multiple conditions for a same item, the discussion herein focuses on the determination of a competitive price for a single item at a single condition. It is understood that the discussion herein may be extended to multiple items and multiple conditions for an item.

The price optimization application 115 may determine a strategy for computing a competitive price from data provided in the data store 112. According to one embodiment, the price optimization application 115 may be configured to blend a price computation based on the offer data 154 with a price computation based on sales data 151. Such blending may be governed by blending parameters 148 in an associated category from category data 124 or other blending parameters 148 associated with the item or the system.

Blending may be desirable in several situations. As a non-limiting example, basing a price solely on historical sales may result in a price that is too high or too low. As one specific example, in the category of video games, a price determined from historical sales often may be higher than the fair market value because the market for video games is constantly changing due to new releases, obsolescence, and other factors. The offer data 154 may be used exclusively, as a non-limiting example, for an item that is newly released. Also, where insufficient sales data 151 exists for the item, the offer data 154 may be used instead. By contrast, when there is insufficient offer data 154, the sales data 151 may be used instead. The sales data 151 may be used exclusively, as a non-limiting example, for an item that has been discontinued.

In one embodiment, the price optimization application 115 may be configured to consider only past sales from the sales data 151 that were made during a predefined time period such as, for example, the last thirty days. However, when insufficient past sales are present in the sales data 151 for the particular item during the predefined time period, the price optimization application 115 may be configured to obtain past sales from the sales data 151 that are older than the predefined time period.

In one embodiment, when neither sufficient sales data 151 nor sufficient offer data 154 are available, the price optimization application 115 may be configured to generate a competitive price for the item using the list price 136 of the item. As a non-limiting example, the price optimization application 115 may set the competitive price for the item to be a percentage of the list price 136. Such an operation may be governed, for example, through a parameter stored in the price optimization configuration data 127.

The current offers from the offer data 154 are filtered by the price optimization application 115. Without filtering, using current offers may result in inaccurate pricing when another seller establishes an offer price far above fair market value or far below fair market value. As a non-limiting example, another seller may price an item at above fair market value when the seller inaccurately believes that the item is worth more than what it would actually command in the marketplace. As another non-limiting example, another seller may price an item at below fair market value when seeking to liquidate the item or to clear a small inventory of the item. Furthermore, setting the price of an item based on current offers by others may make the price vulnerable to arbitrage. For example, another seller may maliciously set a price for an item too high or too low in order to manipulate the price. Such offers may not be legitimate offers.

In one embodiment, the current offers are filtered to exclude offers that exceed the list price 136 associated with the item. In various embodiments, the current offers are filtered by seller using reputational data 157 in order to exclude offers that are not credible by reason of insufficient sales volume, unacceptable customer ratings, and/or other reasons.

Accordingly, the price optimization application 115 may determine offers to sell an item that will be used in determining the competitive price from only a subset of the sellers of an electronic marketplace. The subset of sellers may be selected as those sellers which are associated with a respective reputational score that meets a minimum threshold. For example, the reputational score may meet a minimum threshold when a quantity of customer feedback ratings for the particular seller meets or exceeds a minimum number of customer feedback ratings. Alternatively, or additionally, the reputational score may meet the minimum threshold when the seller has an average customer feedback rating that meets or exceeds a minimum average customer feedback rating. The resulting current offers are considered credible by the price optimization application 115 and may be used in determining the competitive price. In some embodiments, the price optimization application 115 may generate the competitive price also based at least in part on at least one offer by a competitor unassociated with an electronic marketplace.

The price optimization application 115 may process the past sale prices and current offers by transforming them to prices that have been normalized based on item condition. In various embodiments, the past sale prices and the current offers are each associated with an item condition classification. To produce a normalized price, the price optimization application 115 normalizes the given price according to a normalized condition. As a non-limiting example, "new" may be defined as the normalized condition for the items. Accordingly, the price optimization application 115 may apply a pricing factor based on the condition of the item to transform a price to a normalized price. By way of non-limiting examples, the pricing factor for "new" may be 1.00, the pricing factor for "like new" may be 0.95, the pricing factor for "very good" may be 0.90, the pricing factor for "good" may be 0.85, the pricing factor for "acceptable" may be 0.80, and so on. These normalization parameters 145 may be fixed or may vary according to a category associated with the item and/or other factors.

Once the prices from the past sale prices and the current offers have been transformed to normalized prices, then the price optimization application 115 may be configured to determine intermediate results from this data. For example, the price optimization application 115 may generate an average marketplace price from the normalized prices obtained from the current offers. In one embodiment, an average price may be computed for each seller for the items such that multiple instances of the same item sold by a seller may be considered together. Such a result may be weighted as desired. In one embodiment, the result may be weighted according to a reputational score of the respective seller.

Next, the price optimization application 115 is configured to blend the average marketplace price with the average past sale price according to blending parameters 148. Such a blending operation may take the form of the following equation: $p=\alpha\cdot M+\beta\cdot H$, where p is the resulting price, M is the average marketplace price, H is the average past sale price, and $\alpha$, $\beta$ are blending parameters 148. As a non-limiting example, $\alpha$ may be 0.60 and $\beta$ may be 0.40, or other values.

The normalized, blended price may then be denormalized for the conditions sought for the item by the price optimization application 115. For example, the denormalization may involve applying an inverse of a pricing factor associated with a desired item condition. By way of non-limiting examples, the inverse pricing factor for "new" may be 1.00, the pricing factor for "like new" may be 1/0.95, the pricing factor for "very good" may be 1/0.90, the pricing factor for "good" may be 1/0.85, the pricing factor for "acceptable" may be 1/0.80, and so on. In one embodiment, the price optimization application 115 may produce a price denormalized to one item condition, while in another embodiment, the price optimization application 115 may produce prices denormalized to multiple item conditions.

After the competitive price has been denormalized, the price optimization application 115 may be configured to apply further processing to the price. For example, the price optimization application 115 may apply a price ceiling 139 and/or a price floor 142. In other words, the price optimization application 115 may set the competitive price to a price ceiling 139 associated with the item when the competitive price is above the price ceiling 139. Likewise, the price optimization application 115 may be configured to set the competitive price to a price floor 142 associated with the item when the competitive price is below the price floor 142.

Further, the price optimization application 115 may be configured to add a premium to the competitive price according to a seller reputation, or a perceived enhanced service provided by a proprietor or a seller of the electronic marketplace, relative to at least one other seller in the electronic marketplace. For example, the proprietor or seller may have established goodwill that would allow an increased price to be competitive.

The resulting competitive price may then be stored in the data store 112 as desired. Subsequently, when a client 106 requests a network page from the electronic commerce application 118 containing a price for an item in a specified condition, the electronic commerce application 118 will obtain the competitive price generated by the price optimization application 115. In one embodiment, the computation of the competitive price is done in real time when it is requested (e.g., when a catalog network page for the item is requested). In another embodiment, the computation of the competitive price may be performed when the item is added to a catalog, a predefined time interval, and/or at other times.

Figure 2:
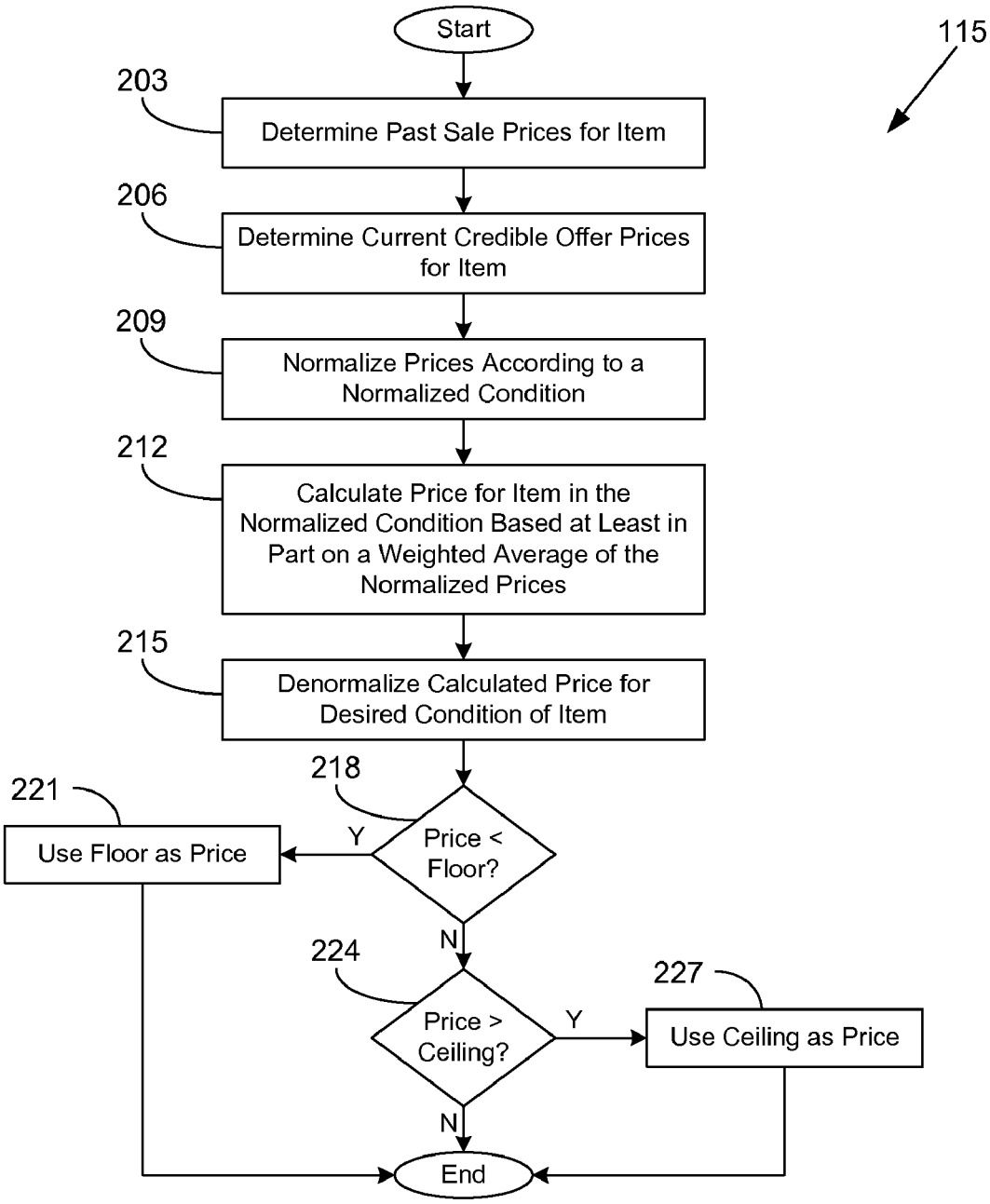
FIGS. 2 and 3 are flowcharts illustrating examples of functionality implemented as portions of a price optimization application executed in a computing resource in the networked environment of FIG. 1 according to various embodiments of the present disclosure.

Referring next to FIG. 2, shown is a flowchart that provides one example of the operation of a portion of the price optimization application 115 according to various embodiments. It is understood that the flowchart of FIG. 2 provides merely an example of the many different types of functional arrangements that may be employed to implement the operation of the portion of the price optimization application 115 as described herein. As an alternative, the flowchart of FIG. 2 may be viewed as depicting an example of steps of a method implemented in the computing resource 103 (FIG. 1) according to one or more embodiments.

Beginning with box 203, the price optimization application 115 determines the past sale prices for an item. Such past sale prices may be determined for a predefined time period such as, for example, the last thirty days or some other time period. The past sale prices may be stored, for example, in sales data 151 (FIG. 1). Next, in box 206, the price optimization application 115 determines the current credible offer prices for the item. The current credible offer prices are determined from the offer data 154 (FIG. 1) available from an electronic marketplace including a plurality of other sellers.

The current offers for the item may be filtered for credibility based at least in part on offer prices. As a non-limiting example, the price optimization application 115 may be configured to exclude prices that meet a threshold, such as, for example, prices that exceed the list price 136 (FIG. 1) of the item or that meet some other threshold. Additionally, current offers may be excluded based at least in part on reputational data 157 (FIG. 1) associated with the respective seller. As a non-limiting example, the price optimization application 115 may be configured to exclude current offers from a seller not meeting a minimum average customer feedback rating and/or not meeting a minimum number of customer feedback ratings.

In box 209, the price optimization application 115 normalizes the prices according to a normalized item condition. In other words, each of the past sale prices and current offers are associated with a respective item condition classification such as, for example, "new," "like new," "very good," "good," "acceptable," and/or other conditions. Each of the associated prices is normalized according to a normalized condition such as, for example, "new." The normalization may involve applying a pricing factor from normalization parameters 145 (FIG. 1) in order to transform the price at a first condition to a price at the normalized condition.

Thereafter, in box 212, the price optimization application 115 calculates a price for the item in the normalized condition based at least in part on a weighted average of the normalized prices. The price optimization application 115 may calculate, for example, an average marketplace price for the item. Such an average marketplace price for the item may be calculated from an average price for the item for each of the sellers in the marketplace. In one embodiment, such average seller prices may be blended together using a score determined from the reputational data 157 of the respective seller. The average past sale price for the item may be blended with the average marketplace price for the item according to blending parameters 148 (FIG. 1).

Next, in box 215, the price optimization application 115 denormalizes the calculated price for an actual condition of an item for which the price is being calculated. Thus, the price optimization application 115 may apply an inverse pricing factor from normalization parameters 145 to transform a price from the normalized condition to the desired condition. As a non-limiting example, if the calculated price has been normalized to the "new" condition, and the desired condition of the item is "very good," the price optimization application 115 will apply a pricing factor to transform the "new" price to a "very good" price for the item according to normalization parameters 145.

Thereafter, the price optimization application 115 may apply one or more adjustments to the calculated price in order to produce a final competitive price for the item. Accordingly, the price optimization application 115 moves to box 218 and determines whether the calculated price is below a price floor 142 (FIG. 1) for the item. If the calculated price is below the price floor 142 for the item, the price optimization application 115 moves to box 221 and uses the price floor 142 as the final price. Thereafter, the price optimization application 115 ends.

If instead, in box 218, the price optimization application 115 determines that the calculated price is not below the price floor 142, the price optimization application 115 moves to box 224 and determines whether the calculated price exceeds a price ceiling 139 (FIG. 1) for the item. If, in box 224, the price optimization application 115 determines that the calculated price exceeds the price ceiling 139, the price optimization application 115 proceeds to box 227 and uses the price ceiling 139 as the final price for the item. Thereafter, the price optimization application 115 ends. If instead, in box 224, the price optimization application 115 determines that the calculated price of the item does not exceed the price ceiling 139, the calculated price is used as the final price for the item and the price optimization application 115 ends.

Figure 3:
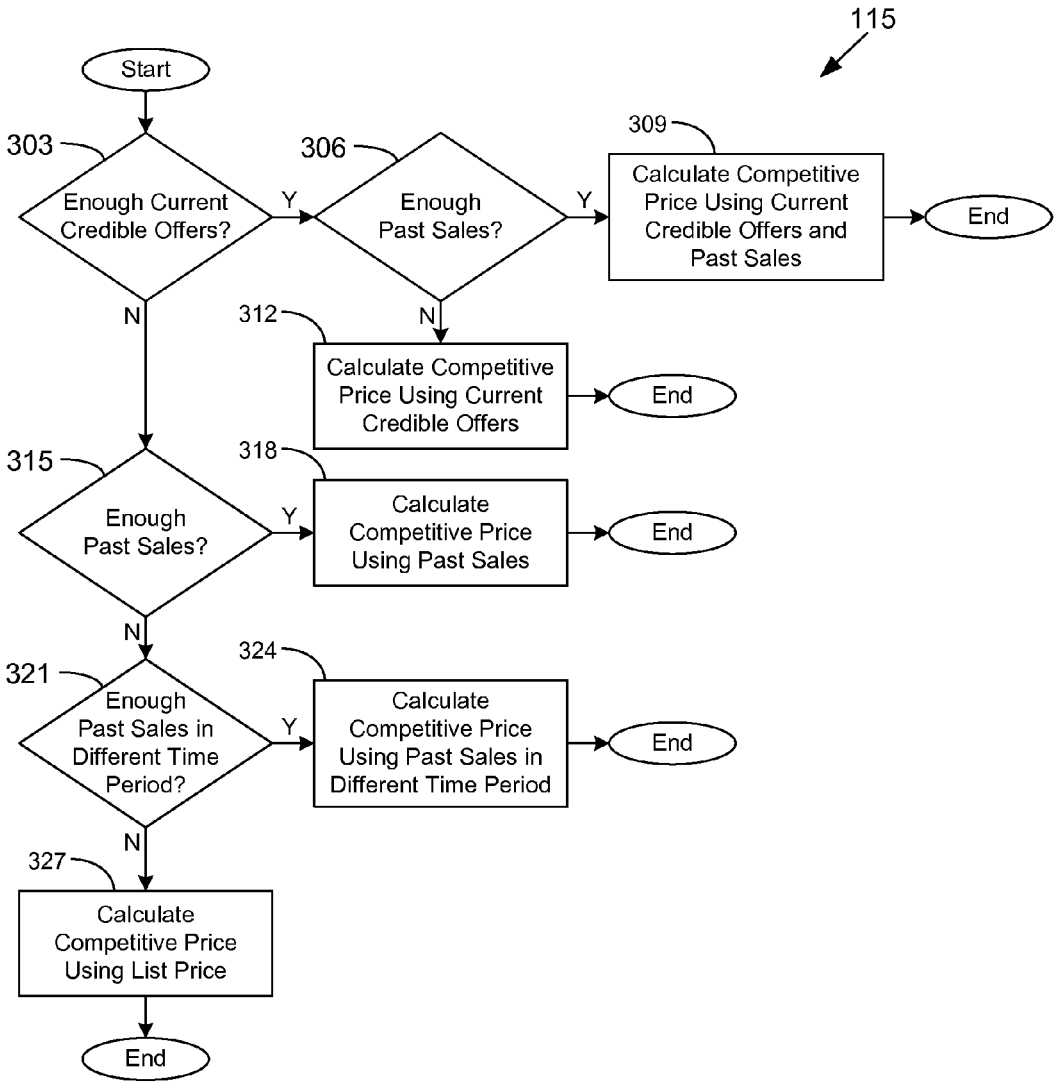

Turning now to FIG. 3, shown is a flowchart that provides one example of the operation of another portion of the price optimization application 115 according to various embodiments. It is understood that the flowchart of FIG. 3 provides merely an example of the many different types of functional arrangements that may be employed to implement the operation of the portion of the price optimization application 115 as described herein. As an alternative, the flowchart of FIG. 3 may be viewed as depicting an example of steps of a method implemented in the computing resource 103 (FIG. 1) according to one or more embodiments. In particular, FIG. 3 further describes selecting pricing data to be used in calculating a competitive price for an item.

Beginning with box 303, the price optimization application 115 determines whether there are a sufficient number of current credible offers for current offers to be considered in setting an item price. If there are enough current credible offers as determined in box 303, the price optimization application 115 proceeds to box 306 and determines whether there are a sufficient number of past sales for the past sales to be considered in setting the item price. If, in box 306, the price optimization application 115 determines that there are enough past sales for past sales to be used, the price optimization application 115 proceeds to box 309 and calculates a competitive price for the item using both the current credible offers and the past sales. Thereafter, the price optimization application 115 ends.

If instead, in box 306, the price optimization application 115 determines that there are not enough past sales to be considered, the price optimization application 115 proceeds to box 312 and calculates the competitive price using only the current credible offers and not the past sales. Thereafter, the price optimization application 115 ends.

If, in box 303, the price optimization application 115 determines that there are not enough current credible offers for the current offers to be considered in setting the price, the price optimization application 115 proceeds to box 315 and determines whether a sufficient number of past sales are present for the past sales to be considered. If, in box 315, the price optimization application 115 determines that there are enough past sales for the past sales to be considered, the price optimization application 115 moves to box 318 and calculates the competitive price for the item using only the past sales. Thereafter, the price optimization application 115 ends.

If instead, in box 315, the price optimization application 115 determines that there are not enough past sales for the past sales to be considered, the price optimization application 115 proceeds to box 321 and determines whether there are a sufficient number of past sales in a different time period. If, in box 321, the price optimization application 115 determines that there are enough past sales in the different time period, the price optimization application 115 moves to box 324 and calculates the competitive price for the item using the past sales from the different time period. The price optimization application 115 then ends.

In box 321, if the price optimization application 115 determines that there are not enough past sales in the different time period for those past sales to be considered, then the price optimization application 115 moves to box 327 and calculates the competitive price using, for example, the list price 136 (FIG. 1) for the item or some other price associated with the item. In one embodiment, the competitive price may be determined as a percentage of the list price 136. Thereafter, the price optimization application 115 ends.

Figure 4:
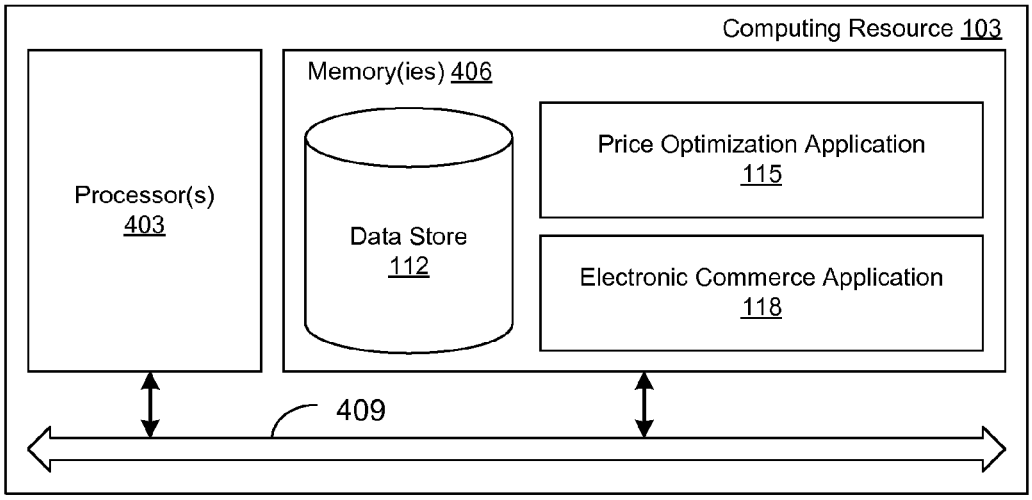
FIG. 4 is a schematic block diagram that provides one example illustration of a computing resource employed in the networked environment of FIG. 1 according to various embodiments of the present disclosure.

With reference to FIG. 4, shown is a schematic block diagram of the computing resource 103 according to an embodiment of the present disclosure. The computing resource 103 includes at least one processor circuit, for example, having a processor 403 and a memory 406, both of which are coupled to a local interface 409. To this end, the computing resource 103 may comprise, for example, at least one server computer or like device. The local interface 409 may comprise, for example, a data bus with an accompanying address/control bus or other bus structure as can be appreciated.

Stored in the memory 406 are both data and several components that are executable by the processor 403. In particular, stored in the memory 406 and executable by the processor 403 are the price optimization application 115, the electronic commerce application 118, and potentially other applications. Also stored in the memory 406 may be a data store 112 and other data. In addition, an operating system may be stored in the memory 406 and executable by the processor 403.

It is understood that there may be other applications that are stored in the memory 406 and are executable by the processors 403 as can be appreciated. Where any component discussed herein is implemented in the form of software, any one of a number of programming languages may be employed such as, for example, C, C++, C#, Objective C, Java, Java Script, Perl, PHP, Visual Basic, Python, Ruby, Delphi, Flash, or other programming languages.

A number of software components are stored in the memory 406 and are executable by the processor 403. In this respect, the term "executable" means a program file that is in a form that can ultimately be run by the processor 403. Examples of executable programs may be, for example, a compiled program that can be translated into machine code in a format that can be loaded into a random access portion of the memory 406 and run by the processor 403, source code that may be expressed in proper format such as object code that is capable of being loaded into a random access portion of the memory 406 and executed by the processor 403, or source code that may be interpreted by another executable program to generate instructions in a random access portion of the memory 406 to be executed by the processor 403, etc. An executable program may be stored in any portion or component of the memory 406 including, for example, random access memory (RAM), read-only memory (ROM), hard drive, solid-state drive, USB flash drive, memory card, optical disc such as compact disc (CD) or digital versatile disc (DVD), floppy disk, magnetic tape, or other memory components.

The memory 406 is defined herein as including both volatile and nonvolatile memory and data storage components. Volatile components are those that do not retain data values upon loss of power. Nonvolatile components are those that retain data upon a loss of power. Thus, the memory 406 may comprise, for example, random access memory (RAM), read-only memory (ROM), hard disk drives, solid-state drives, USB flash drives, memory cards accessed via a memory card reader, floppy disks accessed via an associated floppy disk drive, optical discs accessed via an optical disc drive, magnetic tapes accessed via an appropriate tape drive, and/or other memory components, or a combination of any two or more of these memory components. In addition, the RAM may comprise, for example, static random access memory (SRAM), dynamic random access memory (DRAM), or magnetic random access memory (MRAM) and other such devices. The ROM may comprise, for example, a programmable read-only memory (PROM), an erasable programmable read-only memory (EPROM), an electrically erasable programmable read-only memory (EEPROM), or other like memory device.

Also, the processor 403 may represent multiple processors 403 and the memory 406 may represent multiple memories 406 that operate in parallel processing circuits, respectively. In such a case, the local interface 409 may be an appropriate network 109 (FIG. 1) that facilitates communication between any two of the multiple processors 403, between any processor 403 and any of the memories 406, or between any two of the memories 406, etc. The local interface 409 may comprise additional systems designed to coordinate this communication, including, for example, performing load balancing. The processor 403 may be of electrical or of some other available construction.

Although the price optimization application 115, the electronic commerce application 118, and other various systems described herein may be embodied in software or code executed by general purpose hardware as discussed above, as an alternative the same may also be embodied in dedicated hardware or a combination of software/general purpose hardware and dedicated hardware. If embodied in dedicated hardware, each can be implemented as a circuit or state machine that employs any one of or a combination of a number of technologies. These technologies may include, but are not limited to, discrete logic circuits having logic gates for implementing various logic functions upon an application of one or more data signals, application specific integrated circuits having appropriate logic gates, or other components, etc. Such technologies are generally well known by those skilled in the art and, consequently, are not described in detail herein.

The flowcharts of FIGS. 2 and 3 show the functionality and operation of an implementation of portions of the price optimization application 115. If embodied in software, each block may represent a module, segment, or portion of code that comprises program instructions to implement the specified logical function(s). The program instructions may be embodied in the form of source code that comprises human-readable statements written in a programming language or machine code that comprises numerical instructions recognizable by a suitable execution system such as a processor 403 in a computer system or other system. The machine code may be converted from the source code, etc. If embodied in hardware, each block may represent a circuit or a number of interconnected circuits to implement the specified logical function(s).

Although the flowcharts of FIGS. 2 and 3 show a specific order of execution, it is understood that the order of execution may differ from that which is depicted. For example, the order of execution of two or more blocks may be scrambled relative to the order shown. Also, two or more blocks shown in succession in FIGS. 2 and 3 may be executed concurrently or with partial concurrence. In addition, any number of counters, state variables, warning semaphores, or messages might be added to the logical flow described herein, for purposes of enhanced utility, accounting, performance measurement, or providing troubleshooting aids, etc. It is understood that all such variations are within the scope of the present disclosure.

Also, any logic or application described herein, including the price optimization application 115, the electronic commerce application 118, that comprises software or code can be embodied in any computer-readable medium for use by or in connection with an instruction execution system such as, for example, a processor 403 in a computer system or other system. In this sense, the logic may comprise, for example, statements including instructions and declarations that can be fetched from the computer-readable medium and executed by the instruction execution system. In the context of the present disclosure, a "computer-readable medium" can be any medium that can contain, store, or maintain the logic or application described herein for use by or in connection with the instruction execution system. The computer-readable medium can comprise any one of many physical media such as, for example, electronic, magnetic, optical, electromagnetic, infrared, or semiconductor media. More specific examples of a suitable computer-readable medium would include, but are not limited to, magnetic tapes, magnetic floppy diskettes, magnetic hard drives, memory cards, solid-state drives, USB flash drives, or optical discs. Also, the computer-readable medium may be a random access memory (RAM) including, for example, static random access memory (SRAM) and dynamic random access memory (DRAM), or magnetic random access memory (MRAM). In addition, the computer-readable medium may be a read-only memory (ROM), a programmable read-only memory (PROM), an erasable programmable read-only memory (EPROM), an electrically erasable programmable read-only memory (EEPROM), or other type of memory device.

It should be emphasized that the above-described embodiments of the present disclosure are merely possible examples of implementations set forth for a clear understanding of the principles of the disclosure. Many variations and modifications may be made to the above-described embodiment(s) without departing substantially from the spirit and principles of the disclosure. All such modifications and variations are intended to be included herein within the scope of this disclosure and protected by the following claims.

Therefore, the following is claimed:

1. A non-transitory computer-readable medium storing a program executable in at least one computing device, the program comprising:

code that determines a plurality of current offers to sell an item from a subset of sellers in an electronic marketplace, each one of the subset of sellers being associated with a quantity of customer feedback ratings meeting a minimum quantity threshold and an average customer feedback rating meeting a minimum rating threshold;

code that determines a plurality of past sale prices for the item being ordered through the electronic marketplace during a predefined time period;

code that calculates an average past sale price for the item in a common one of a plurality of predefined item classifications using the past sale prices;

code that calculates an average marketplace price for the item in the common one of the predefined item classifications using the current offers;

code that blends the average past sale price and the average marketplace price to generate a normalized competitive price for the item;

code that converts the normalized competitive price to a competitive price for the item in another one of the predefined item classifications;

code that sets the competitive price to a price ceiling associated with the item when the competitive price is above the price ceiling;

code that sets the competitive price to a price floor associated with the item when the competitive price is below the price floor;

code that does not change the competitive price when the competitive price is not above the price ceiling and when the competitive price is not below the price floor; and code that offers the item for sale in the specified item condition at the competitive price.

2. The non-transitory computer-readable medium of claim 1, wherein the code that blends is configured to blend the average past sale price and the average marketplace price based at least in part on a quantity of the past sale prices and a quantity of the current offers.

3. The non-transitory computer-readable medium of claim 1, wherein the code that determines a plurality of past sale prices for the item being ordered through the electronic marketplace during a predefined time period is further configured to use a different predefined time period in response to determining that a quantity of past sale prices for the item being ordered through the electronic marketplace during the predefined time period does not meet a threshold.

4. A system, comprising:

at least one computing device; and a price optimization application executable in the at least one computing device, the price optimization application comprising:

logic that determines a plurality of current offers to sell an item from a subset of sellers in an electronic marketplace, each one of the subset of sellers being associated with a respective reputational score that meets a minimum threshold;

logic that determines a respective average seller price for the item from the current offers of each respective one of the subset of sellers;

logic that determines a corresponding seller reputational weight for each respective average seller price based at least in part on the respective reputational score associated with the respective one of the subset of sellers; and logic that generates a competitive price for the item based at least in part on an average marketplace price determined by blending the average seller prices according to the corresponding seller reputational weights.

5. The system of claim 4, wherein the respective reputational score is based at least in part on an average customer feedback rating associated with the one of the subset of sellers.

6. The system of claim 4, wherein the respective reputational score is based at least in part on a quantity of customer feedback ratings associated with the one of the subset of sellers.

7. The system of claim 4, wherein each of the current offers is associated with one of a plurality of predefined item classifications, each one of the predefined item classifications indicating an item condition and a pricing factor relative to a common one of the predefined item classifications, the common one of the predefined item classifications being a normalized item classification.

8. The system of claim 7, wherein the price optimization application further comprises:

logic that normalizes an offer price associated with each one of the current offers by applying the pricing factor associated with the respective one of the predefined item classifications, thereby producing a normalized offer price.

9. The system of claim 8, wherein the logic that determines the respective average seller price is configured to determine the respective average seller price according to the respective normalized offer prices.

10. The system of claim 8, wherein the item is associated with one of the predefined item classifications, and the price optimization application further comprises logic that denormalizes the competitive price of the item by applying an inverse of the pricing factor of the one of the predefined item conditions associated with the item.

11. The system of claim 4, wherein the logic that generates a price for the item further comprises logic that sets the competitive price to a price floor associated with the item in response to determining that the competitive price is below the price floor.

12. The system of claim 4, wherein the logic that generates a price for the item further comprises logic that sets the competitive price to a price ceiling associated with the item in response to determining that the competitive price is above the price ceiling.

13. The system of claim 4, wherein the logic that generates a competitive price for the item further comprises logic that adds a premium to the competitive price according to a perceived enhanced service provided by a proprietor of the electronic marketplace relative to at least one other seller of the electronic marketplace.

14. The system of claim 4, wherein the logic that generates a competitive price for the item further comprises logic that adds a premium to the competitive price according to a reputation of a seller in the electronic marketplace relative to at least one other seller of the electronic marketplace.

15. The system of claim 4, wherein the logic that generates a competitive price for the item is configured to generate the competitive price based at least in part on a plurality of past sale prices of the item being ordered through the electronic marketplace.

16. The system of claim 15, wherein each of the past sale prices is associated with one of a plurality of predefined item classifications, each one of the predefined item classifications indicates an item condition and a pricing factor relative to a common one of the predefined item classifications, the common one of the predefined item classifications is a normalized item classification, and the logic that generates a competitive price for the item further comprises logic that normalizes each one of the past sale prices by applying the pricing factor associated with the respective one of the predefined item classifications.

17. The system of claim 4, wherein the logic that generates a competitive price for the item is configured to generate the competitive price based at least in part on a list price associated with the item.

18. The system of claim 4, wherein the current offers exclude offers that exceed a list price associated with the item.

19. The system of claim 4, further comprising an electronic commerce application executable in the at least one computing device, the electronic commerce application comprising logic that facilitates order origination for each one of the subset of sellers in the electronic marketplace.

20. The system of claim 19, wherein the electronic commerce application further comprises logic that offers the item for sale by a proprietor of the electronic marketplace according to the competitive price generated by the price optimization application.

21. The system of claim 4, wherein the price optimization application is configured to be executed according to a predefined time interval.

22. A method, comprising the steps of:

determining, in at least one computing device, a plurality of current offers to sell an item from a subset of sellers in an electronic marketplace, the current offers being stored in a memory, each one of the subset of sellers being associated with a respective reputational score that meets a minimum threshold;

determining, in the at least one computing device, a plurality of past sale prices for the item from a plurality of sellers in the electronic marketplace, the past sale prices being stored in the memory;

determining, in the at least one computing device, a respective average seller price for the item from the current offers of each respective one of the subset of sellers;

determining, in the at least one computing device, a corresponding seller reputational weight for each respective average seller price based at least in part on the respective reputational score associated with the respective one of the subset of sellers;

determining, in the at least one computing device, an average marketplace price for the item by blending the average seller prices according to the corresponding seller reputational weights; and generating, in the at least one computing device, a competitive price for the item based at least in part on the average marketplace price and the past sale prices.

23. The method of claim 22, further comprising the step of transforming the past sale prices and a price associated with each one of the current offers by applying a respective normalizing factor to convert a price at a first one of a plurality of item classifications to a price at a common one of the item classifications.

24. The method of claim 23, wherein the respective normalizing factor is predetermined for a category of the item.

25. The method of claim 22, further comprising the step of generating the respective reputational score based at least in part on a plurality of customer feedback ratings.

26. The method of claim 22, wherein the step of generating further comprises the step of generating the competitive price based at least in part on at least one offer by a competitor unassociated with the electronic marketplace.

* * * * *